US008748725B2

(12) United States Patent
Iwase et al.

(10) Patent No.: US 8,748,725 B2
(45) Date of Patent: Jun. 10, 2014

(54) KEY SWITCH FOR ELECTRONIC PIANO

(71) Applicant: Kabushiki Kaisha Kawai Gakki Seisakusho, Hamamatsu (JP)

(72) Inventors: Masahiko Iwase, Hamamatsu (JP); Hideyuki Ishida, Hamamatsu (JP)

(73) Assignee: Kabushiki Kaisha Kawai Gakki Seisakusho, Hamamatsu-Shi (JP)

( * ) Notice: Subject to any disclaimer, the term of this patent is extended or adjusted under 35 U.S.C. 154(b) by 71 days.

(21) Appl. No.: 13/629,453

(22) Filed: Sep. 27, 2012

(65) Prior Publication Data

US 2013/0074684 A1 Mar. 28, 2013

(30) Foreign Application Priority Data

Sep. 28, 2011 (JP) ..... 2011-211815
Sep. 28, 2011 (JP) ..... 2011-211818

(51) Int. Cl.
*G10H 1/34* (2006.01)

(52) U.S. Cl.
USPC ..... 84/745; 84/744; 84/433

(58) Field of Classification Search
USPC ..... 84/745, 744, 433
See application file for complete search history.

(56) References Cited

U.S. PATENT DOCUMENTS

| | | | | |
|---|---|---|---|---|
| 3,935,784 | A * | 2/1976 | Koepke | 84/435 |
| 4,079,651 | A * | 3/1978 | Matsui | 84/690 |
| 4,416,178 | A * | 11/1983 | Ishida | 84/661 |
| 4,679,477 | A * | 7/1987 | Monte | 84/719 |
| 5,062,342 | A * | 11/1991 | Nagatsuma | 84/744 |
| 5,453,571 | A * | 9/1995 | Adachi et al. | 84/658 |
| 5,717,176 | A * | 2/1998 | Dahlstrom | 200/1 B |
| 5,883,327 | A * | 3/1999 | Terada et al. | 84/653 |
| 5,952,629 | A * | 9/1999 | Yoshinaga et al. | 200/5 A |
| 6,303,887 | B1 * | 10/2001 | Ando | 200/512 |
| 6,365,820 | B1 * | 4/2002 | Kondo et al. | 84/658 |
| 6,765,142 | B2 * | 7/2004 | Sakurada et al. | 84/719 |
| 6,849,796 | B2 * | 2/2005 | Yamaguchi | 84/720 |
| 7,060,883 | B2 * | 6/2006 | Nagaoka et al. | 84/423 R |
| 7,256,359 | B2 * | 8/2007 | Nishida | 200/1 B |
| 7,319,187 | B2 * | 1/2008 | Sunako | 84/662 |
| 7,361,825 | B2 * | 4/2008 | Nishida | 84/626 |
| 8,134,060 | B2 * | 3/2012 | Taniguchi | 84/423 R |
| 8,481,841 | B2 * | 7/2013 | Shimoda | 84/744 |
| 2008/0210079 | A1 * | 9/2008 | Osuga et al. | 84/423 R |
| 2010/0326259 | A1 * | 12/2010 | Taniguchi | 84/744 |
| 2011/0179935 | A1 * | 7/2011 | Ishida | 84/20 |
| 2013/0074684 | A1 * | 3/2013 | Iwase et al. | 84/745 |
| 2013/0319210 | A1 * | 12/2013 | Yoshida | 84/745 |

FOREIGN PATENT DOCUMENTS

| | | |
|---|---|---|
| JP | 8-44361 | 2/1996 |
| JP | 2007-52357 | 3/2007 |

* cited by examiner

*Primary Examiner* — Robert W Horn
(74) *Attorney, Agent, or Firm* — Christie, Parker & Hale, LLP

(57) ABSTRACT

A key switch for an electronic piano, which makes it possible to increase an allowable range for shift of a movable contact without increasing the size of the key switch of the three-contact type. The key switch includes a substrate having first to third stationary contacts arranged thereon side by side in the lengthwise direction of a pivotal member as one of a key and a hammer. Each stationary contact has a common contact and a non-common contact. The common contact has an extended portion extending between two non-common contacts. The key switch has first to third movable contacts arranged side by side on an elastic switch body, for being sequentially brought into contact with the common contacts and non-common contacts of the stationary contacts as the switch body is pressed by the pivotal member, to thereby output signals indicative of key depression information.

13 Claims, 9 Drawing Sheets

KEY SWITCH FOR ELECTRONIC PIANO

CROSS-REFERENCE TO RELATED APPLICATION

This application claims priority to and the benefit of Japanese Patent Application Number 211815/2011, filed on Sep. 28, 2011, and Japanese Patent Application Number 211818/2011, filed on Sep. 28, 2011, the entire disclosures of which are incorporated herein by reference.

BACKGROUND OF THE INVENTION

1. Field of the Invention

This invention relates to a key switch for an electronic piano, which is configured to detect a motion of a key or a hammer that pivotally moves in accordance with depression of the key, as key depression information.

2. Description of the Related Art

Conventionally, the above-mentioned type of key switch for an electronic piano has been disclosed e.g. in Japanese Laid-Open Patent Publication (Kokai) No. 2007-52357. The key switch is of a three-contact type that detects a motion of a key in three stages. The key switch is comprised of a dome-shaped rubber switch fixedly secured to the lower surface of the key and a switch board disposed below the rubber switch. The rubber switch has cylindrical first to third switch elements extending vertically downward from the top wall and arranged in a front-rear direction (lengthwise direction) of the key. The first switch element is the longest of all the first to third switch elements, and the third switch element is the shortest of all. The first to third switch elements have lower end portions formed with respective first to third movable contacts. On the other hand, the switch board has first to third stationary contacts in a manner opposed to the first to third movable contacts, respectively.

As the key pivotally moves during key depression, the rubber switch of the key switch is pressed by the key to be deformed. The first to third movable contacts are sequentially brought into contact with the first to third stationary contacts, respectively, in accordance with the deformation of the rubber switch, whereby respective ON signals are output.

FIG. 10 shows the arrangement of the stationary contacts of a general three-contact type key switch in the prior art. As shown in FIG. 10, each of the first to third stationary contacts CS1 to CS3 is comprised of a common contact (hatched contact) and a non-common contact (unhatched contact). The common contacts of the respective first to third stationary contacts CS1 to CS3 have the same reference potential e.g. by being grounded, and the non-common contacts have a potential different from the reference potential. The common contacts and the non-common contacts are each formed e.g. of carbon printed on the switch board, and have a rectangular shape linearly extending in the front-rear direction (left-right direction as viewed in FIG. 10). Each of the common contacts and the associated one of the non-common contacts are closely opposed to each other in the left-right direction (vertical direction as viewed in FIG. 10). Further, the three common contacts and the three non-common contacts are both arranged side by side in a state adjacent to each other in the front-rear direction.

With this arrangement, when the key is depressed, first to third movable contacts cm1 to cm3 each formed e.g. of carbon are brought into contact with the common contacts and the non-common contacts in a manner bridging the respective pairs of the common contact and the non-common contact, to make the common contacts and the non-common contacts conductive, whereby ON signals are output.

The present assignee has already proposed the above-described type of key switch for an electronic piano e.g. in Japanese Laid-Open Patent Publication (Kokai) No. H08-44361. The key switch is comprised of a switch board having first and second stationary contacts arranged thereon side by side in a lengthwise direction of a hammer, switch bodies each formed of a soft elastic material and mounted on the switch board in a manner opposed to the hammer, and first and second movable contacts arranged side by side on each switch body in a manner opposed to the first and second stationary contacts thereof, respectively. The distance between the first movable contact and the first stationary contact is set to be smaller than that between the second movable contact and the second stationary contact. Further, on the surface of the switch body, there is formed a single pressure-receiving protuberance extending in a direction orthogonal to the lengthwise direction of the hammer.

According to this key switch, when the hammer pivotally moves in accordance with key depression and comes into contact with the pressure-receiving protuberance of the switch body, the switch body is pressed via the pressure-receiving protuberance by the hammer, whereby the switch body is compressed and deformed. When the switch body is deformed, the first movable contact and the first stationary contact opposed to each other with the shorter distance therebetween are brought into contact with each other first, whereby a first ON signal is output. Then, as the hammer further pivotally moves, the switch body pivotally moves about the first movable contact held in contact with the first stationary contact, whereby the second movable contact is brought into contact with the second stationary contact and a second ON signal is output.

The first and second ON signals are sequentially output to a tone generation controller. The tone generation controller determines, based on the presence or absence of the first and second ON signals, whether or not a key has been depressed, and identifies an associated key number when a depressed key has been depressed. Further, the tone generation controller determines a key depression speed based on a difference in output timing between the first and second ON signals and controls tone generation of the electronic piano according to these results.

In the conventional key switch constructed as above, the relative position of the movable contact to the stationary contact when brought into contact with the stationary contact (hereinafter referred to as "the contact position of the movable contact") is apt to shift in the front-rear direction (i.e. in the lengthwise direction of the key) e.g. due to variation in the operation (deformation) of the rubber switch or positional shift that occurs in printing of the stationary contacts on the switch board. However, in the conventional key switch, the first to third stationary contacts CS1 to CS3 has the three rectangular common contacts and the three rectangular non-common contacts located close to each other in the front-rear direction.

For this reason, when the contact position of the movable contact shifts in the front-rear direction and the movable contact deviates even slightly from the stationary contact, the movable contact can be erroneously brought into contact with an adjacent stationary contact, causing erroneous detection. For example, when the first movable contact cm1 deviates from its original position (indicated by a solid line) corresponding to the stationary contact CS1 to a position (indicated by a broken line) shifted toward the second stationary contact CS2 to come into contact with a non-common contact of the second stationary contact CS2, an ON signal which indicates that the second stationary contact CS2 is in the ON state is erroneously output.

In order not only to achieve stabilization of ON signals from a key switch but also to reduce the amount of heat generated by the key switch, it is preferred that the electric resistance of a movable contact formed e.g. of carbon is held as low as possible. Further, in order to reduce the electric resistance, it is effective to increase the diameter of the movable contact, for example. However, when the movable contact of the conventional key switch has an increased diameter, it is more likely that the movable contact is brought into contact with an adjacent stationary contact due to shift of its contact position, and therefore the magnitude of the diameter of the movable contact has to be limited.

Further, as a solution to the above problem, it can be envisaged e.g. to increase the length of the common contact of each stationary contact and that of the non-common contact of the same or increase the space between the stationary contacts. However, since the entire length of the key switch of the three-contact type is originally larger than that of a key switch of the two-contact type, the above-mentioned method further increases the entire length of the key switch, which causes an increase in the size of the key switch.

There is another problem. As described above, according to the conventional technique, the key switch of the two-contact type, which has the first and second movable and stationary contacts, makes it possible to reliably bring the two movable contacts into contact with the respective associated stationary contacts to thereby achieve stable switching operation. On the other hand, the key switch of the three-contact type, which has the first to third movable and stationary contacts, has recently been used in an electronic piano so as to acquire more detailed key depression information and realize a piano tone closer to a tone generated by an acoustic piano. However, when the conventional technique is applied to the key switch of the three-contact type, there is a fear that stable switching operation cannot be ensured for reasons mentioned below, and therefore there remains room to be improved in this point.

In the key switch of the three-contact type, the arrangement length of the movable contacts (i.e. the distance from the first movable contact to the third movable contact) in the lengthwise direction of the hammer is larger than in the key switch of the two-contact type. For this reason, even when the switch body is pressed via the single pressure-receiving protuberance and is pivotally moved about the first movable contact held in contact with the first stationary contact, contact pressure between the third movable contact distant from the first movable contact and the third stationary contact sometimes becomes insufficient. This sometimes makes it impossible to bring the third movable contact into secure contact with the third stationary contact, which can cause a faulty operation.

As a solution to this problem, it can be envisaged e.g. to dispose the pressure-receiving protuberance closer to the third movable contact. With this arrangement, however, the first movable contact having already been in contact with the first stationary contact is apt to move up from the first stationary contact during halfway through a pivotal motion of the hammer, which makes it difficult to maintain the contact state. Therefore, also in this case, there is a fear that a faulty operation can be caused. Further, it can be envisaged to dispose the first to third movable and stationary contacts closer to each other in the lengthwise direction of the hammer so as to avoid the above-mentioned contact failure between the contacts. In this case, however, difference in output timing between the ON signals is reduced, which causes degradation of accuracy in detecting the hammer motion.

SUMMARY OF THE INVENTION

It is an object of present invention to provide a key switch for an electronic piano, which when the key switch is of the three-contact type, makes it possible to increase an allowable range for shift of a movable contact without increasing the size of the key switch, to thereby prevent an erroneous operation and detect key depression information with high accuracy.

It is another object of the present invention to provide a key switch for an electronic piano, which even when the key switch is of the three-contact type, enables each contact to make a reliable contact during a pivotal motion of a pivotal member and maintain the contact state to thereby ensure a stable switching operation and detect key depression information with further accuracy.

To attain the above object, in a first aspect of the present invention, there is provided a key switch for an electronic piano, for detecting a motion of a pivotal member which is one of a key, and a hammer that pivotally moves in accordance with depression of the key, as key depression information, comprising a substrate on which first, second, and third stationary contacts are arranged side by side in a lengthwise direction of the pivotal member, each of the first to third stationary contacts comprising a common contact having a predetermined reference potential, and a non-common contact having a different potential from the reference potential, the common contact and the non-common contact being arranged in a direction orthogonal to the lengthwise direction of the pivotal member in a manner opposed to each other with a predetermined spacing therebetween, and at least one of the common contacts of each two stationary contacts adjacent to each other having an extended portion extending in the orthogonal direction in a manner inserted between two of the non-common contacts; an elastic switch body mounted on the substrate and configured to be opposed to the pivotal member when the key is in a key-released state; and first, second, and third movable contacts arranged side by side on the switch body in a manner opposed to the respective first to third stationary contacts, and configured to be sequentially brought into contact with the common contacts and non-common contacts of the first to third stationary contacts as the switch body is pressed by the pivotal member pivotally moving during key depression, to thereby output signals indicative of the key depression information.

According to the key switch for an electronic piano, the first to third stationary contacts are arranged on the substrate in the lengthwise direction of the pivotal member which is as one of the key and the hammer. Each of the first to third stationary contacts is comprised of a common contact having a predetermined reference potential and a non-common contact having a different potential from the reference potential, and the common contact and the non-common contact are opposed to each other with a predetermined spacing therebetween in a direction orthogonal to the lengthwise direction of the pivotal member.

As the pivotal member pivotally moves by depression of the key, the elastic switch body is pressed by the pivotal member to be compressively deformed. This compressive deformation of the switch body sequentially brings the first to third movable contacts arranged side by side on the switch body into contact with the first to third common contacts and non-common contacts of the first to third stationary contacts in a manner bridging each associated pair of the common contacts and the non-common contacts, whereby the signals indicative of key depression information are sequentially output.

Further, according to the present invention, at least one of the common contacts of two stationary contacts adjacent to each other has an extended portion extending in the orthogonal direction in a manner inserted between two of the non-common contacts. Therefore, even when the contact positions of the movable contacts associated with the two stationary contacts shift in the lengthwise direction of the pivotal member, causing the movable contacts to slightly deviate out from their originally associated stationary contacts, the state of contact with the common contacts can be maintained by the extended portions of the respective common contacts existing at corresponding locations, and the contact of each movable contact with the non-common contact of a non-associated stationary contact is prevented at the same time. This makes it possible to increase the allowable range for each of the movable contacts without increasing the size of the key switch, and hence prevent an erroneous operation and detect key depression information more accurately.

To attain the above object, in a second aspect of the present invention, there is provided a key switch for an electronic piano, for detecting a motion of a pivotal member which is one of a key, and a hammer that pivotally moves in accordance with depression of the key, as key depression information, comprising a substrate on which first, second, and third stationary contacts are arranged side by side in a lengthwise direction of the pivotal member, an elastic switch body mounted on the substrate and configured to be opposed to the pivotal member when the key is in a key-released state, first, second, and third movable contacts arranged side by side on the switch body in a manner opposed to the respective first to third stationary contacts, and configured to be sequentially brought into contact with the first to third stationary contacts as the switch body is pressed by the pivotal member pivotally moving during key depression, to thereby output signals indicative of the key depression information, and a pressure-receiving protuberance formed on the switch body for abutment with the pivotally moving pivotal member and configured to cause a point of the abutment to shift in the lengthwise direction of the pivotal member during halfway through the pivotal motion of the pivotal member.

According to the key switch for an electronic piano, when the key is depressed, the pivotal member (key or hammer) pivotally moves and comes into abutment with the pressure-receiving protuberance, whereby the elastic switch body is pressed and compressively deformed. This compressive deformation of the switch body first brings the first movable contacts into contact with the first stationary contact, then brings the second movable contact into contact with the second stationary contact, and finally brings the third movable contact into contact with the third stationary contact, whereby the signals indicative of key depression information are sequentially output. Further, the point of the abutment of the pivotal member with the pressure-receiving protuberance shifts in the lengthwise direction of the pivotal member during halfway through the pivotal motion of the pivotal member.

As described above, according to the key switch of the present invention, the pivotal member that pivotally moves in accordance with key depression comes into abutment with the pressure-receiving protuberance to press the switch body via the pressure-receiving protuberance. Further, the point of the abutment of the pivotal member with the pressure-receiving protuberance shifts in the lengthwise direction of the pivotal member during halfway through the pivotal motion of the pivotal member. Therefore, differently from the conventional case where the abutment point of the hammer is immovable, it is possible to press the switch body by the pivotal member effectively while moving the abutment point. As a consequence, even when the key switch is of the three-contact type, it is possible to cause the first to third movable contacts to make reliable contacts with the respective first to third stationary contacts during the pivotal motion of the pivotal member and maintain the contact state, whereby it is possible to ensure a stable switching operation, and detect key depression information more accurately.

Preferably, the pressure-receiving protuberance comprises a plurality of protuberances arranged side by side in the lengthwise direction of the pivotal member.

According to this preferred embodiment, the abutment point of the pivotal member on the pressure-receiving protuberance changes from one protuberance to another during halfway through the pivotal motion of the pivotal member, i.e. the abutment point moves stepwise in the lengthwise direction of the pivotal member. Therefore, it is possible to obtain the above-described advantageous effect provided by the second aspect.

Preferably, the pressure-receiving protuberance continuously extends in the lengthwise direction of the pivotal member.

According to this preferred embodiment, as the pivotal member pivotally moves, the abutment point of the pivotal member continuously shifts in the lengthwise direction of the pivotal member, with the pivotal member compressing the protuberance. This makes it possible to obtain the above-described advantageous effect provided by the second aspect.

Preferably, the pressure-receiving protuberance is disposed close to the second movable contact on the switch body.

According to this preferred embodiment, the pivotal member presses the switch body via the pressure-receiving protuberance located in the vicinity of the second movable contact as the central contact of the first to third movable contacts, and therefore it is possible to deform the switch body in the front-rear direction with excellent balance to thereby further improve the stability of the switching operation of the key.

Preferably, the key switch further comprises a support protrusion which is disposed on the switch body at an opposite side of the first movable contact to the third movable contact and is opposed to the substrate, and as the switch body is pressed by the pivotal member, the support protrusion is brought into abutment with the substrate to cause the switch body to pivotally move about a point of the abutment as a fulcrum.

According to this preferred embodiment, as the switch body is pressed by the pivotal member, the support protrusion disposed on the switch body as above is brought into abutment with the substrate to cause the switch body to pivotally move about the point of the abutment as a fulcrum. As a consequence, deformation of the switch body is assisted to be smoothly deformed, so that combined with the shift of the abutment point of the pivotal member, it is possible to further improve the stability of the switching operation of the key switch.

The above and other objects, features, and advantages of the present invention will become more apparent from the following detailed description taken in conjunction with the accompanying drawings.

DETAILED DESCRIPTION OF PREFERRED EMBODIMENTS

Figure 1:
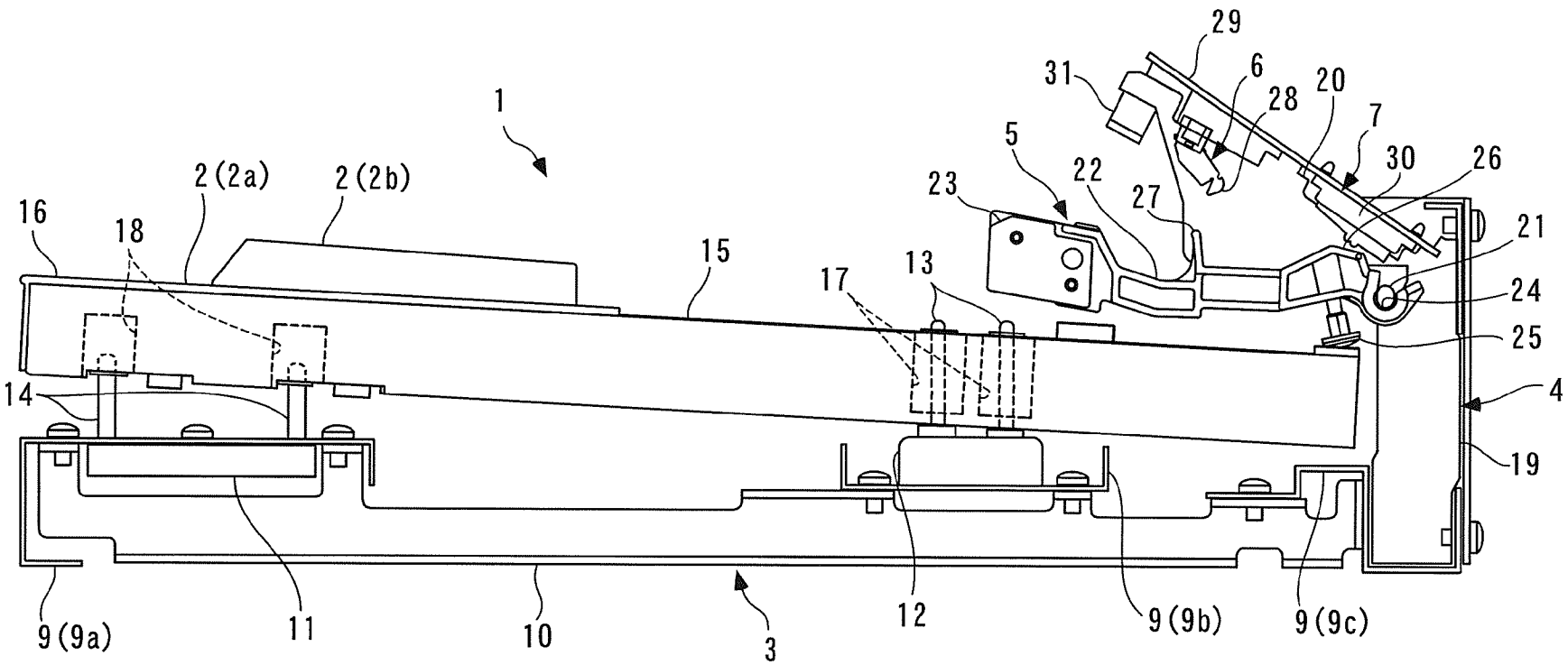
FIG. 1 is a partially cut-away side view of a keyboard device for an electronic piano to which is applied the present invention.

The present invention will now be described in detail with reference to the drawings showing a preferred embodiment thereof. FIG. 1 shows a keyboard device for an electronic piano, according to the embodiment of the present invention, in a key-released state.

As shown in FIG. 1, the keyboard device 1 includes a plurality of keys 2 (only one of white keys 2*a* and one of black keys 2*b* are shown) arranged side by side in a left-right direction (depth direction as viewed in FIG. 1) of the electronic piano, a keyboard chassis 3 for supporting the keys 2, a hammer support 4 connected to the rear end (right end as viewed in FIG. 1) of the keyboard chassis 3, a plurality of hammers 5 (only one of which is shown) each provided for an associated one of the keys 2, for being pivotally moved in accordance with depression of the key 2, a plurality of let-off members 6 (only one of which is shown) each provided for an associated one of the hammers 5, for adding a let-off feeling to the touch feeling of the associated key 2 when the key 2 is depressed, and a key switch 7 for detecting key depression information on the keys 2.

The keyboard chassis 3 is formed by assembling three support rails 9, i.e. a front rail 9*a*, a central rail 9*b*, and a rear rail 9*c* each extending in the left-right direction, and five reinforcement ribs 10 extending in the front-rear direction, in parallel crosses. The keyboard chassis 3 is secured on a keybed (not shown). Each of the support rails 9 and the ribs 10 is made of iron plate formed into a predetermined shape by press blanking and bending. Each support rail 9 is formed to have a reduced thickness (e.g. 1.0 mm) for reduction of weight, whereas each rib 10 is formed to have an increased thickness (e.g. 1.6 mm) for reinforcement.

A keyframe front 11 is secured to the lower surface of the front rail 9*a*, and a keyframe center 12 is secured to the upper surface of the central rail 9*a*. The keyframe front 11 and the keyframe center 12 each formed as a thick flat plate member of a synthetic resin extend in the left-right direction along the entire front rail 9*a* and the entire central rail 9*b*, respectively. On the keyframe center 12, a large number of balance pins 13 are erected at respective front and rear locations corresponding to the white keys 2*a* and the black keys 2*b*, respectively, in a manner arranged side by side in the left-right direction. Further, on the keyframe front 11, a large number of front pins 14 are erected at respective front and rear locations corresponding to the white keys 2*a* and the black keys 2*b*, respectively, in a manner arranged side by side in the left-right direction.

Each of the keys 2 is comprised of a wooden key body 15 extending in the front-rear direction and having a rectangular cross section, and a key cover 16 made of a synthetic resin and bonded to the top and front surfaces of a front half of the key body 15. A portion of the key body 15 rearward of the center of the key body 15 is formed with balance pin holes 17, and the key 2 is pivotally supported by balance pins 13 via the balance pin holes 17. Further, a front end of the key body 15 is formed with front pin holes 18, and engagement between the front pin holes 18 and the respective front pins 14 prevents the key 2 from laterally swinging during a pivotal motion thereof.

The hammer support 4 is made of a synthetic resin and formed by connecting a plurality of molded articles, each covering e.g. one octave, to each other. The hammer support 4 extends over the length of all the hammers 5 in the left-right direction, and is fixed to the rear rail 9*c* of the keyboard chassis 3 with screws. The hammer support 4 includes a hammer supporting part 19 erected from near the rear rail 9*c*, and a switch mounting part 20 extending forward and obliquely upward from an upper end of the hammer supporting part 19. The upper end of the hammer supporting part 19 is formed with a horizontal pin-shaped fulcrum shaft portion 21 for supporting the hammers 5.

Each of the hammers 5 is comprised of an arm-like hammer body 22 extending in the front-rear direction, and weight plates 23 (only one of which is shown) attached to left and right sides of the front end of the hammer body 22, respectively. The hammer body 22 is made of a synthetic resin, while the weight plates 23 are each made of a metal material, such as iron, having a relatively high specific gravity. The hammer body 22 has a rear end thereof formed with an arcuate shaft hole 24. The shaft hole 24 is engaged with the fulcrum shaft portion 21, whereby the hammer 5 is pivotally supported on the hammer support 4.

Further, a capstan screw 25 is movably screwed into the lower surface of the hammer body 22 at a location slightly forward of the shaft hole 24. The hammer 5 is placed on the rear end of the associated key 2 via the capstan screw 25. A portion of the upper surface of the hammer body 22 between the shaft hole 24 and the capstan screw 25 functions as an actuator portion 26 for causing the key switch 7 to operate when the key 2 is depressed. Further, on a central portion of the upper surface of the hammer body 22 in the front-rear direction, there is formed a plate-like engaging projection 27 that is brought into engagement with an associated let-off member 6 when the key 2 is depressed.

The let-off member 6 is formed by a molded article of a predetermined elastic material (e.g. styrene-based thermoplastic elastomer), and is mounted to the switch mounting part 20 of the hammer support 4. The let-off member 6 extends rearward and downward from the switch mounting part 20, and has an end thereof formed as a head part 28 projecting from a neck part. In a key-released state, the head part 28 is opposed to the engaging projection 27 of the hammer 5.

The key switch 7 is comprised of a switch board 29 formed by a printed circuit board, and switch bodies 30 each formed by a rubber switch and attached to the lower surface of the switch board 29 in association with the keys 2, respectively. The switch board 29 has a rear end thereof inserted in the switch mounting part 20 and a central portion thereof fixed to the switch mounting part 20 with screws. In a key-released state of each key 2, the associated switch body 30 is opposed to the actuator portion 26 of the associated hammer 5 in a manner slightly spaced therefrom. On the front end of the lower surface of the switch mounting part 20, there is provided a hammer stopper 31 made e.g. of foamed urethane and configured to restrict upward pivotal motion of the hammer 5.

Next, a description will be given of the operation of the keyboard device 1 constructed as above. When depressed from the key-released state shown in FIG. 1, the key 2 pivotally moves about the balance pins 13 in the counterclockwise direction as viewed in FIG. 1, and in accordance with this pivotal motion, the hammer 5 is pushed up via the capstan screw 25 to pivotally move upward (clockwise as viewed in FIG. 1) about the fulcrum shaft portion 21.

During halfway through the pivotal motion of the hammer 5, the engaging projection 27 is brought into engagement with the head part 28 of the let-off member 6 to cause the head part 28 to press the let-off member 6 while compressing the same, whereby a reaction force acting on the hammer 5 from the let-off member 6 is increased. When the hammer 5 further pivotally moves, the engaging projection 27 is disengaged from the head part 28, whereby the reaction force from the let-off member 6 suddenly disappears. The increase and sudden disappearance of the reaction force from the let-off member 6 gives let-off feeling closely similar to that of an acoustic piano.

Then, when the hammer 5 comes into abutment with the hammer stopper 31, the upward pivotal motion of the hammer 5 is stopped. During the upward pivotal motion of the hammer 5, the actuator portion 26 presses the switch body 30 of the key switch 7 to thereby turn on the key switch 7, whereby key depression information on the key 2 corresponding to the amount of pivotal motion of the hammer 5 is detected and output to a tone generation controller (not shown). The tone generation controller controls the tone generation of the electronic piano based on the detected key depression information.

Thereafter, when the key 2 is released, the key 2 performs pivotal motion in a direction reverse to the direction of pivotal motion of the key 2 when depressed, and returns to the key-released state shown in FIG. 1, and accordingly, the hammer 5 also pivotally moves downward to return to the key released state.

Figure 2:
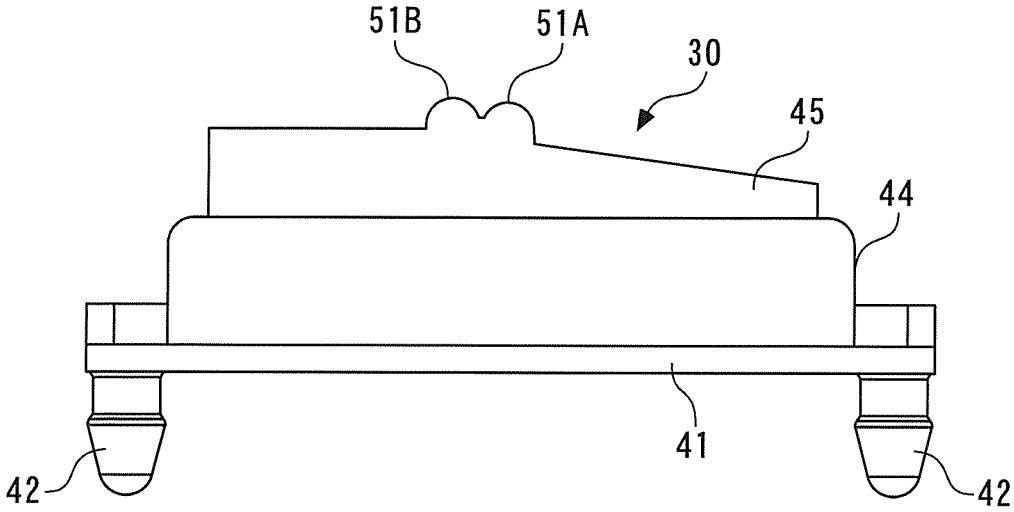
FIG. 2 is a side view of a switch body of a key switch.
Figure 3:
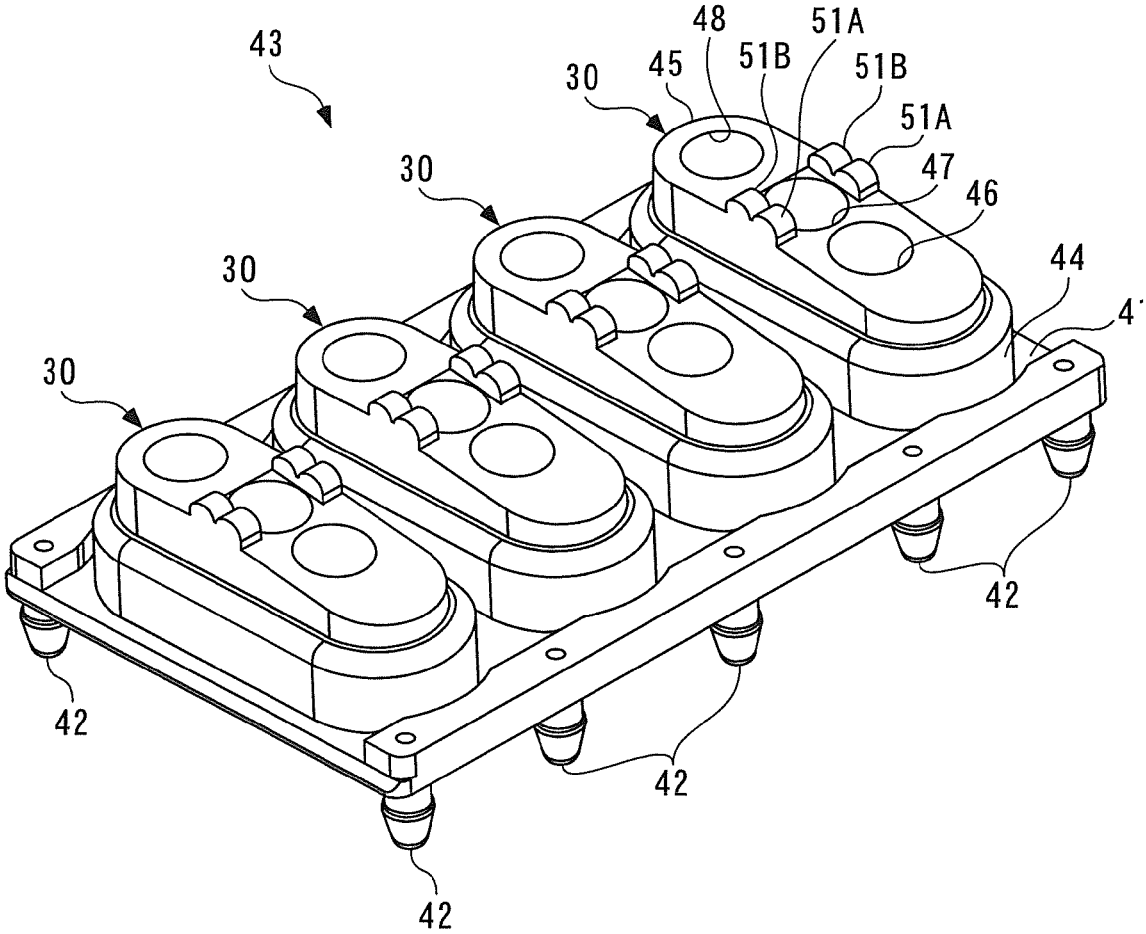
FIG. 3 is a perspective view of a switch body unit integrally formed with a plurality of switch bodies, as viewed obliquely from above.
Figure 4:
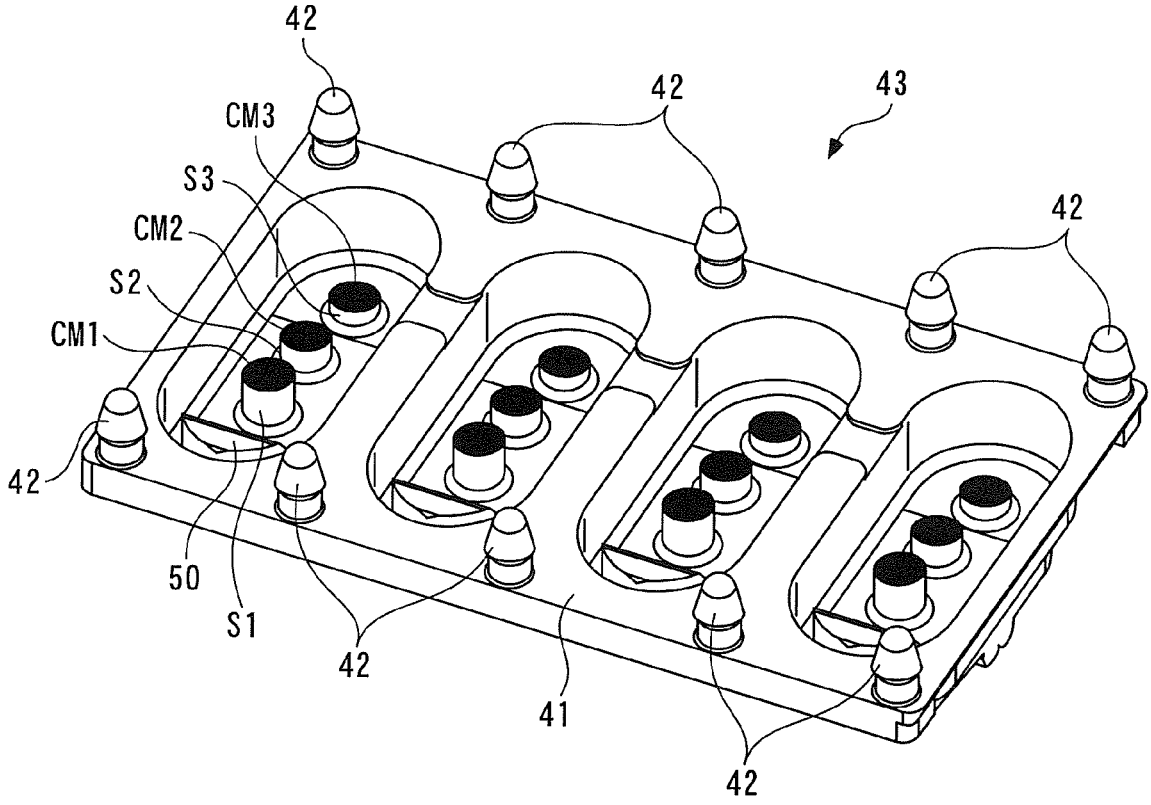
FIG. 4 is a perspective view of the FIG. 3 switch body unit as viewed obliquely from below.

Next, the key switch 7 according to the present invention will be described in detail with reference to FIGS. 2 to 6. Each switch body 30 of the key switch 7 is made of very soft rubber, such as silicone rubber. As shown in FIGS. 3 and 4, four switch bodies 30 arranged side by side, a base 41 connecting between the switch bodies 30, and a plurality of mounting leg parts 42 each projecting downward, as viewed in FIG. 3, from the base 41 are integrally molded into a switch body unit 43.

Each switch body 30 has an elliptical planar shape elongated in the front-rear direction, and has a dome shape, as a whole, formed by a thin peripheral wall part 44 rising from the base part 41 and a movable part 45 continuous with the peripheral wall part 44. As shown in FIG. 2, the movable part 45 has a surface sloped forward (rightward as viewed in FIG. 2) toward the base 41.

In the surface of the movable part 45, there are formed three cylindrical recessed parts 46 to 48 in a manner arranged side by side in the front-rear direction. Each of first to third switch elements S1 to S3 projects from the bottom rim of an associated one of the recessed parts 46 to 48 via a thin wall part 49. The first to third switch elements S1 to S3 have ends thereof formed with first to third movable contacts CM1 to CM3 made of carbon, respectively. Further, the movable part 45 has a support protrusion 50 formed in front of the first switch element S1. The support protrusion 50 is formed into a block shape and extends close to the base 41.

Further, on the surface of the movable part 45, two pressure-receiving protuberances (hereinafter simply referred to as "the protuberances") 51A and 51B are formed adjacent to each other at each of left and right sides of the central recessed part 47. The protuberances 51A and 51B each have a generally semicircular shape and have the same size.

Figure 5:
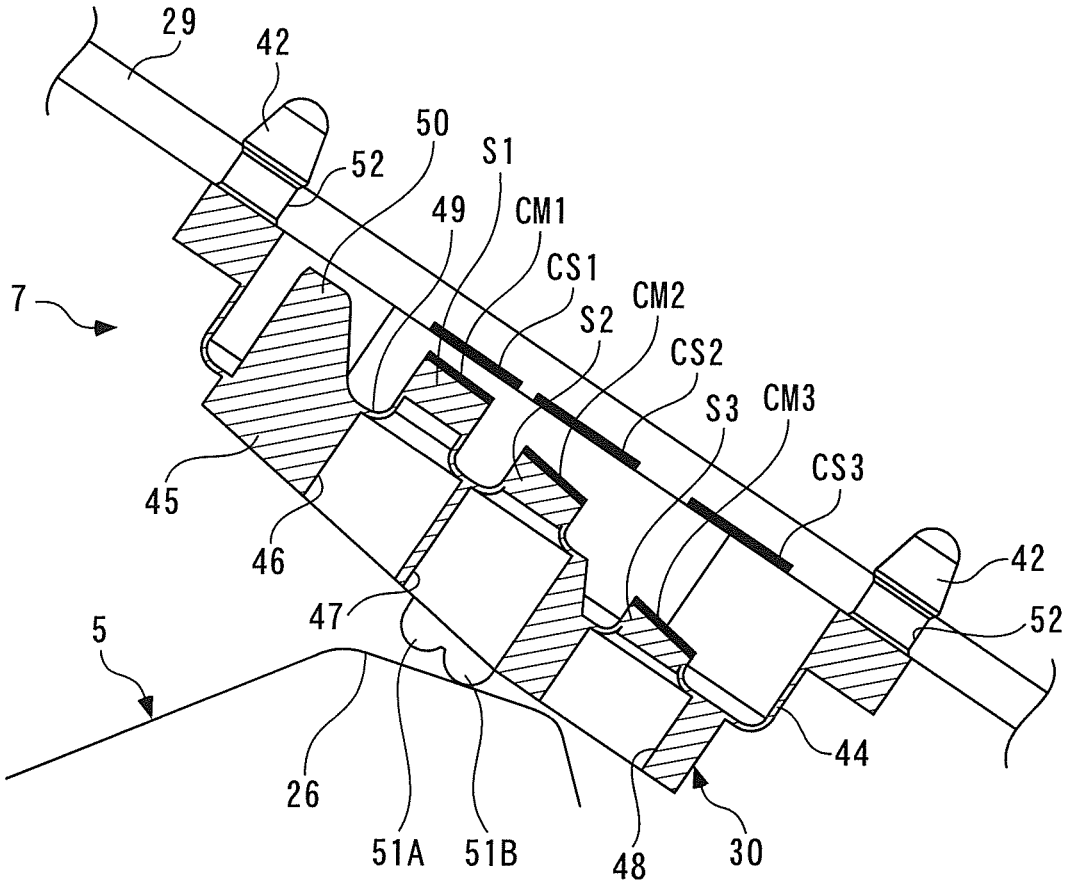
FIG. 5 is a side view of the switch body in a state mounted on a switch board.

The switch body 30 constructed as above is attached to the lower surface of the switch board 29 by inserting the leg parts 42 into respective associated holes 52 of the switch board 29, as shown in FIG. 5, by making use of the elasticity of the leg parts 42. When the key 2 is in the key-released state, the actuator portion 26 of the hammer 5 is closely opposed to the rear protuberances 51B of the switch body 30. Note that FIG. 5 shows a state immediately after the actuator portion 26 has been brought into contact with the protuberances 51B by key depression.

Further, in the key-released state, the support protrusion 50 of the movable part 45 is closely opposed to the switch board 29, and the first to third movable contacts CM1 to CM3 face respective first to third stationary contacts CS1 to CS3 formed on the switch board 29. The distance between each movable contact and a stationary contact associated therewith becomes shorter in the order of the first movable and stationary contacts CM1 and CS1, the second movable and stationary contacts CM2 and CS2, and the third movable and stationary contacts CM3 and CS3. In short, a pair of movable and stationary contacts which are closer to the front side of the key switch 7 have a shorter distance therebetween.

Figure 6:
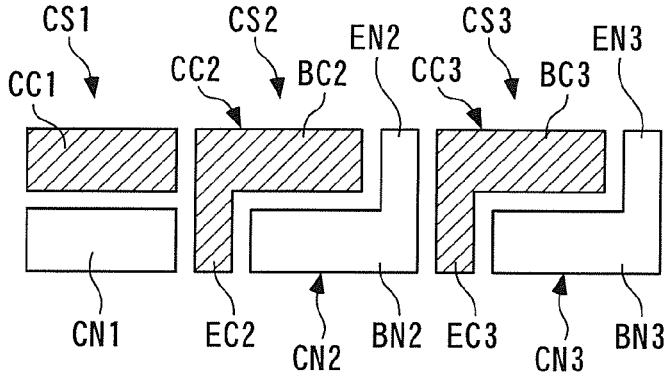
FIG. 6 is a plan view showing the arrangement of stationary contacts on the switch board.

As shown in FIG. 6, the first to third stationary contacts CS1 to CS3 are arranged side by side in the front-rear direction (left-right direction as viewed in FIG. 6). The first to third stationary contacts CS1 to CS3 are formed by respective pairs of contacts, i.e. a first common contact CC1 and a first non-common contact CN1, a second common contact CC2 and a second non-common contact CN2, and a third common contact CC3 and a third non-common contact CN3. The first to third common contacts CC1 to CC3 shown in a hatched manner in FIG. 6 are grounded and have the same reference potential. On the other hand, each of the first to third non-common contacts CN1 to CN3 has a predetermined potential different from the reference potential.

As shown in FIG. 6, each of the first common contact CC1 and the first non-common contact CN1 is formed into a rectangular shape elongated in the front-rear direction. The first common contact CC1 and the first non-common contact CN1 are identical in length and width to each other, and are opposed to each other in the left-right direction (vertical direction as viewed in FIG. 6) with a predetermined spacing smaller than the diameter of the first movable contact CM1.

On the other hand, each of the second and third common contacts CC2 and CC3 and the second and third non-common contacts CN2 and CN3 is formed by a body portion and an extended portion extending from one end of the body portion, which form an L shape. The body portion, denoted by BC2, of the second common contact CC2 and the body portion, denoted by BN2, of the second non-common contact CN2 are each formed into a rectangular shape identical in length and width to the first common contact CC1 and the first non-common contact CN1. The body portion BC2 and the body portion BN2 extend in the front-rear direction on the respective extension lines of the first common contact CC1 and the first non-common contact CN1, and are opposed to each other with a predetermined spacing therebetween. On the other hand, the extended portion, denoted by EC2, of the second common contact CC2 extends from the front end of the body portion BC2 in the left-right direction in a manner inserted between the first non-common contact CN1 and the body portion BN2 of the second non-common contact CN2. Further, the extended portion, denoted by EN2, of the second non-common contact CN2 extends from the rear end of the body portion BN2 in the left-right direction in a manner inserted between the body portion BC2 of the second common contact CC2 and the body portion BC3 of the third common contact CC3.

Similarly, the body portion, denoted by BC3, of the third common contact CC3 and the body portion, denoted by BN3, of the third non-common contact CN3 are each formed into a rectangular shape identical in length and width to the body portion BC2 of the second common contact CC2 and the body portion BN2 of the second non-common contact CN2. The body portion BC3 and the body portion BN3 extend in the front-rear direction on the respective extension lines of the second common contact CC2 and the second non-common contact CN2, and are opposed to each other with the predetermined spacing therebetween. On the other hand, the extended portion, denoted by EC3, of the third common contact CC3 extends from the front end of the body portion BC3 in the left-right direction in a manner inserted between the body portion BN2 of the second non-common contact CN2 and the body portion BN3 of the third non-common contact CN3. Further, the extended portion, denoted by EN3, of the third non-common contact CN3 extends from the rear end of the body portion BN3 in the left-right direction along the rear edge of the body portion BC3 of the third common contact CC3.

Next, the operation of the key switch 7 constructed as above will be described in detail with reference to FIGS. 5 and 7. When the key 2 is depressed, the hammer 5 pivotally moves in a clockwise direction as viewed in FIG. 5, and the actuator portion 26 of the hammer 5 is brought into abutment with the rear protuberances 51B of the switch body 30, whereby the switch body 30 is pressed via the protuberances 51B and is compressively deformed. This compressive deformation brings the first movable contact CM1 into contact with the first common contact CC1 and first non-common contact CN1 of the first stationary contact CS1 simultaneously in a manner bridging these, whereby the two contacts CC1 and CN1 are made conductive and the first switch element S1 is turned on.

Around when the first movable contact CM1 is brought into contact with the first stationary contact CS1, the support protrusion 50 of the switch body 30 is brought into abutment with the switch board 29, whereafter the switch body 30 is deformed while being pivotally moved counterclockwise, as viewed in FIG. 5, about the support protrusion 50 as a fulcrum. When the hammer 5 further pivotally moves, the second movable contact CM2 is brought into contact with the second common contact CC2 and second non-common contact CN2 of the second stationary contact CS2 simultaneously in a manner bridging these, whereby the two contacts CC2 and CN2 are made conductive and the second switch element S2 is turned on. Further, around when the second movable contact CM2 is brought into contact with the second stationary contact CS2, the actuator portion 26 of the hammer 5 moves away from the rear protuberances 51B of the switch body 30 to come into contact with the front protuberances 51A, and from this time on presses the switch body 30 via the front protuberances 51A. Then, when the hammer further pivotally moves, the third movable contact CM3 is brought into contact with the third common contact CC3 and third non-common contact CN3 of the third stationary contact CS3 simultaneously in a manner bridging these, whereby the two contacts CC3 and CN3 are made conductive and the third switch element S3 is turned on.

The ON signals from the respective first to third switch elements S1 to S3 are sequentially input to the tone generation controller. For example, the tone generation controller determines, based on the ON operation of the key switch 7, that the key 2 has been depressed, and identifies the key number of the key 2, and calculates the pivotal speed of the hammer 5 based on differences in output timing between the first to third switch elements S1 to S3. The tone generation controller controls the tone generation of the electronic piano based on the obtained results.

Figure 7:
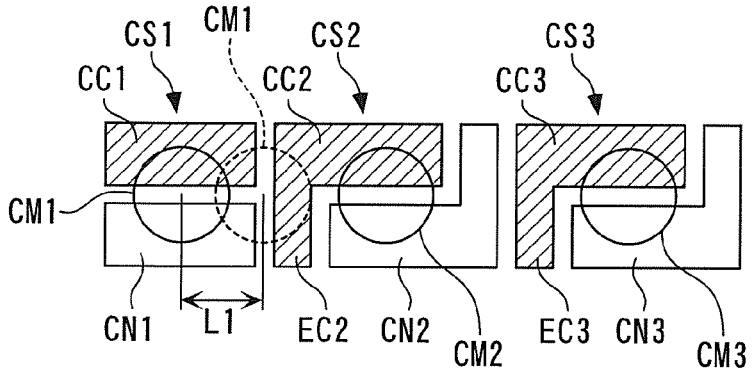
FIG. 7 is a plan view useful in explaining the positional relationship between movable contacts and the stationary contacts during operation of the key switch.

Further, for example, in a case where the contact position of the first movable contact CM1 shifts rearward, causing the first movable contact CM1 to deviate out from the first stationary contact CS1 as indicated by a broken line in FIG. 7, the first movable contact CM1 comes into simultaneous contact with the first non-common contact CN1 and the extended portion EC2 of the second common contact CC2 located rearward of the first non-common contact CN1, whereby the state of contact with the common contact is maintained and at the same time, contact with the non-common contact CN2 of the second stationary contact CS2 is prevented. Thus, the ON state of the first switch element S1 is maintained.

Although not shown, in a case where the second movable contact CM2 deviates forward from the second stationary contact CS2, the second movable contact CM2 comes into simultaneous contact with the second non-common contact CN2 and the extended portion EC2 of the second common contact CC2 located forward of the second non-common contact CN2, and in a case where the second movable contact CM2 deviates rearward from the second stationary contact CS2, the second movable contact CM2 comes into simultaneous contact with the second non-common contact CN2 and the extended portion EC3 of the third common contact CC3 located rearward of the second non-common contact CN2, whereby, in both the cases, the ON state of the second switch element S2 is maintained. Similarly, in a case where the third movable contact CM3 deviates forward from the third stationary contact CS3, the third movable contact CM3 comes into simultaneous contact with the third non-common contact CN3 and the extended portion EC3 of the third common contact CC3 located forward of the third non-common contact CN3, whereby the ON state of the third switch element S3 is maintained.

Further, as shown in FIG. 7, a limit that can be allowed for rearward shift of the contact position of the first movable contact CM1 is determined by the rear edge of the extended portion EC2. Therefore, when the distance between the limit position and the central position of the first stationary contact CS1 is defined as an allowable range for the shift of the first movable contact CM1, the allowable range is indicated by a distance L1.

Figure 8:
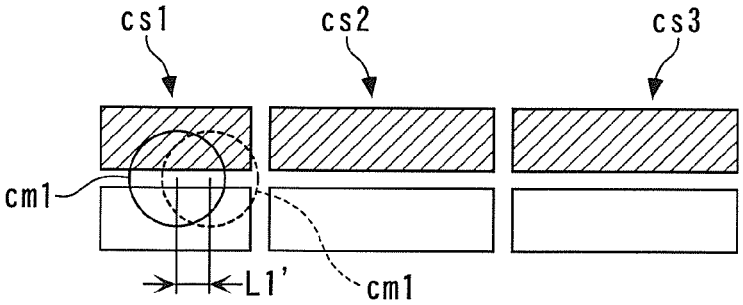
FIG. 8 is a plan view useful in explaining the positional relationship between movable contacts and stationary contacts during operation of a conventional key switch.

On the other hand, in the conventional key switch, when the contact position of the first movable contact cm1 shifts rearward as indicated by a broken line in FIG. 8, the limit position is determined by the front edge of the second stationary contact CS2 close to the first stationary contact CS1, and therefore the allowable range is indicated by a distance L1' which is shorter than the distance L1. In short, it is understood that the present embodiment makes it possible to increase the allowable range for the shift of the first movable contact CM1.

As described above, according to the present embodiment, even when the contact positions of the first to third movable contacts CM1 to CM3 shift in the lengthwise direction of the hammer 5, causing the first to third movable contacts CM1 to CM3 to deviate out from their originally associated stationary contacts, the state of contact of each of the first to third movable contacts with the associated common contacts can be maintained by the extended portions EC2 and EC3 of the respective second and third common contacts CC2 and CC3 existing at corresponding locations, and the contact of each movable contact with the non-common contact of a non-associated stationary contact is prevented at the same time. This makes it possible to increase the allowable range of shift for each of the first to third movable contacts CM1 to CM3 without increasing the size of the key switch 7, and hence prevent an erroneous operation and detect key depression information more accurately.

Further, according to the present embodiment, since the front and rear protuberances 51A and 51B are formed on the surface of the switch body 30, the actuator portion 26 of the hammer 5 comes into abutment with the rear protuberances 51B at an early stage of a pivotal motion of the hammer 5 caused by key depression, to press the switch body 30 via the protuberances 51B. Then, the abutment point of the actuator portion 26 changes from the rear protuberances 51B to the front protuberances 51A at a time point halfway through the pivotal motion of the hammer 5, whereby the switch body 30 comes to be pressed via the front protuberances 51A.

Therefore, differently from the conventional case where the abutment point of the hammer is immovable, it is possible to press the switch body 30 effectively while moving the abutment point. Thus, even when the key switch 7 is of the three-contact type as in the present embodiment, it is possible to cause the first to third movable contacts CM1 to CM3 to make respective reliable contacts with the first to third stationary contacts CS1 to CS3 during a pivotal motion of the hammer 5 and maintain the contact state. For example, it is possible to prevent contact pressure between the third movable contact CM3 and the third stationary contact CS3 from becoming insufficient or to prevent the first movable contact CM1 from moving off from the first stationary contact CS1 at a final stage of the pivotal motion of the hammer 5, where the third switch element S3 is turned on, to thereby ensure a stable switching operation and detect key depression information with high accuracy.

Further, since the protuberances 51A and 51B are located close to the recessed part 47 at the center of the switch body 30, i.e. in the vicinity of the second movable contact CS2, it is possible to deform the switch body 30 in the front-rear direction with excellent balance. Furthermore, since the protuberances 51A and 51B are formed on each of the left and right sides of the recessed part 47, it is possible to deform the switch body 30 in the left-right direction with excellent balance. Thus, the stability of the switching operation of the key switch 7 can be further improved.

Furthermore, along with pressing of the switch body 30 by the hammer 5, the support protrusion 50 located forward of the first movable contact CM1 of the switch body 30 is brought into contact with the switch board 29, and the switch body 30 is caused to pivotally move about the contact point as a fulcrum. This assists deformation of the switch body 30, so that combined with the shift of the abutment point of the hammer 5, it is possible to further improve the stability of the switching operation of the key switch 7.

Figure 9:
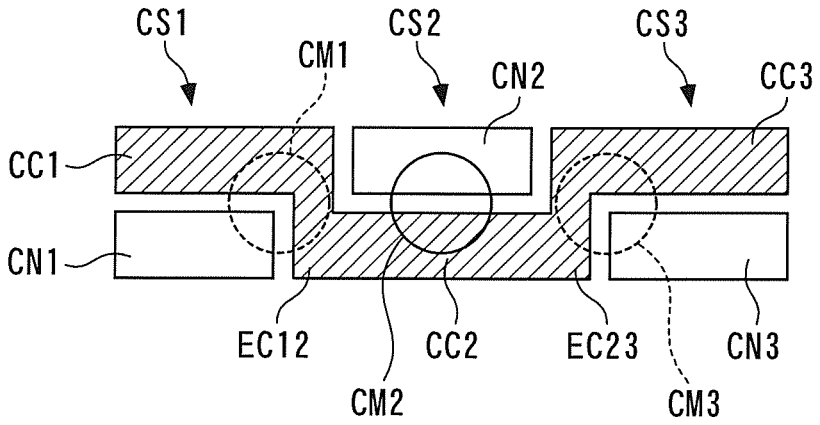
FIG. 9 is a plan view showing the arrangement of stationary contacts according to a variation of the present embodiment.
Figure 10:
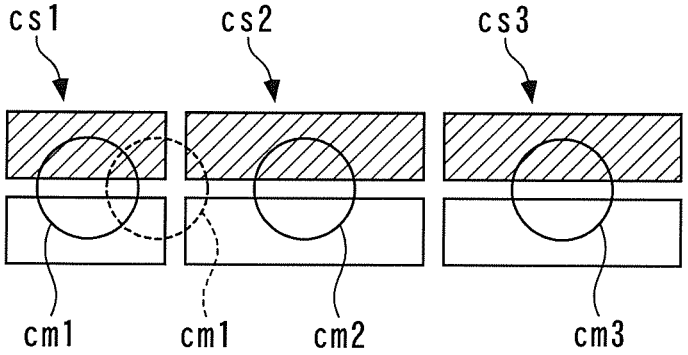
FIG. 10 RELATED ART
FIG. 10 is a plan view showing the arrangement of the stationary contacts on a switch board of the conventional key switch.

FIG. 9 shows a variation of the above-described embodiment. The present variation is distinguished from the above-described embodiment only by the arrangement pattern of the first to third stationary contacts CS1 to CS3. As shown in FIG. 9, in the present variation, the three common contacts CC1 to CC3 and three non-common contacts CN1 to CN3 of the first to third stationary contacts CS1 to CS3 are arranged in a staggered manner in the left-right direction.

The first and second common contacts CC1 and CC2 are provided with an extended portion EC12 formed in a manner connecting the respective closer ends thereof. The extended portion EC12 extends in the left-right direction between the first and second non-common contacts CN1 and CN2. Similarly, the second and third common contacts CC2 and CC3 are provided with an extended portion EC23 formed in a manner connecting the respective closer ends thereof. The extended portion EC23 extends in the left-right direction between the second and third non-common contacts CN2 and CN3. The other arrangement is identical to that in the above-described embodiment.

With this configuration, as shown in FIG. 9, even when the contact positions of the first to third movable contacts CM1 to CM3 shift in the lengthwise direction of the hammer 5, causing the first to third movable contacts CM1 to CM3 to deviate out from their originally associated stationary contacts, the state of contact of each of the first to third movable contacts CM1 to CM3 with the common contact can be maintained by the extended portions EC12 and EC23 existing at corresponding locations, and the contact of each movable contact with the non-common contact of a non-associated stationary contact is prevented at the same time. Therefore, it is possible to obtain the same advantageous effects as obtained by the embodiment described hereinabove.

Figure 11:
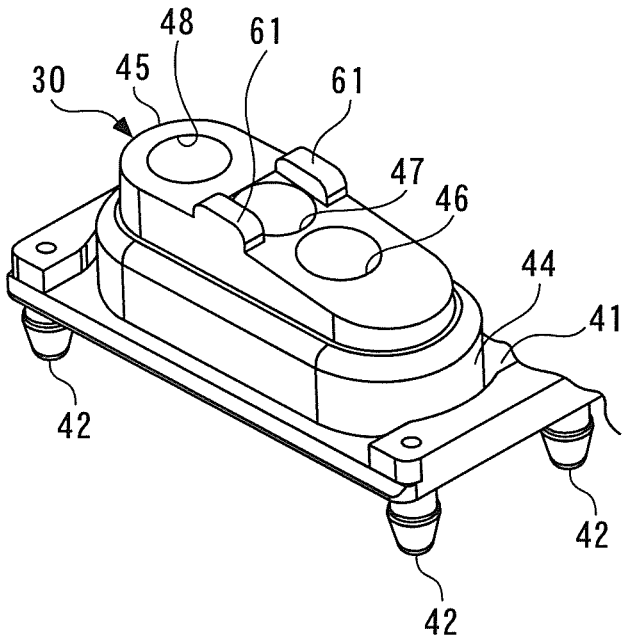
FIG. 11 is a perspective view of a switch body according to a variation of the present embodiment, as viewed obliquely from above.
Figure 12:
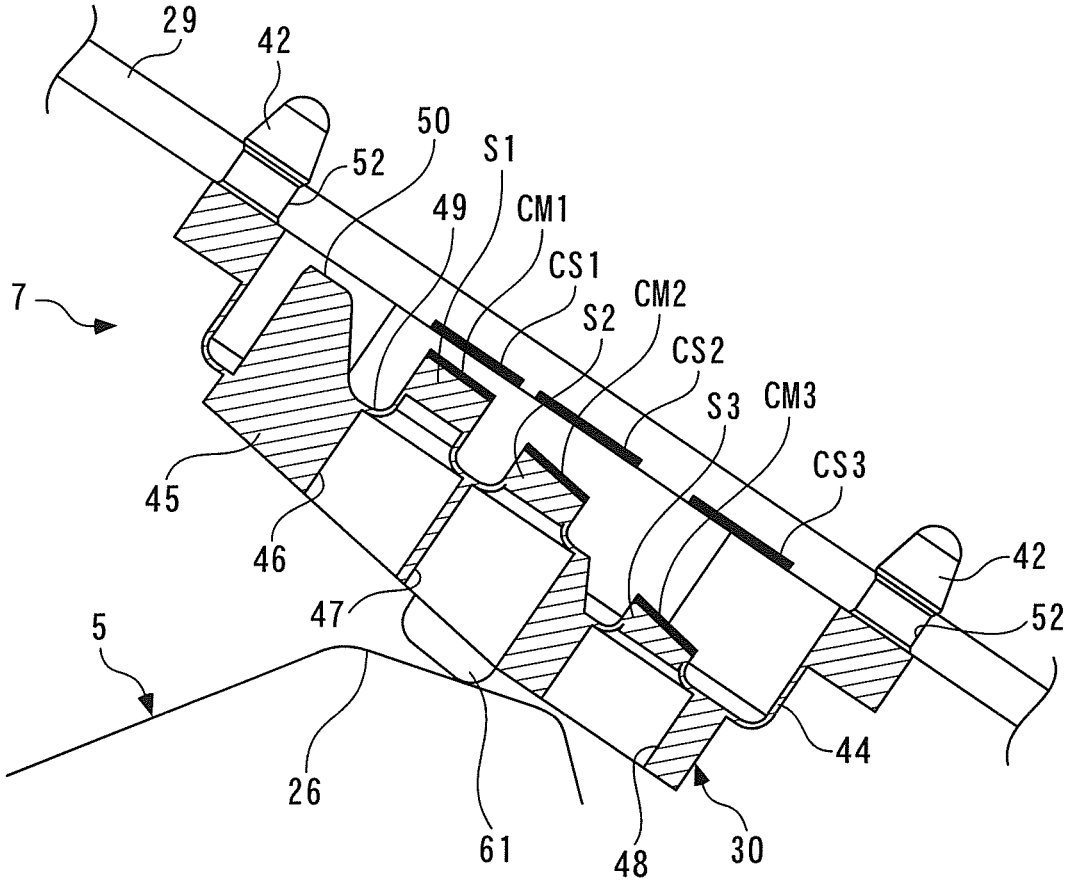
FIG. 12 is a side view of the FIG. 11 switch body in a state mounted on the switch board.

FIGS. 11 and 12 show another variation of the key switch 7. This variation is distinguished from the embodiment and the variation described hereinabove only by the configuration of protuberances of the switch body 30. As shown in FIGS. 11 and 12, similarly to the protuberances 51A and 51B in the embodiment, the protuberances, denoted by 61, are provided on the respective opposite sides of the recessed part 47 at the center of the surface of the switch body 30. Each of the protuberances 61 is formed as a single protuberance continuously extending in the front-rear direction. The other arrangement is identical to that in the above-described embodiment.

With this arrangement, as the hammer 5 pivotally moves, the abutment point of the actuator portion 26 of the hammer 5 continuously shifts from rear to front, with the hammer 5 compressing the protuberances 61, so that it is possible to obtain the same advantageous effects as obtained by the embodiment described hereinabove.

Note that the present invention is by no means limited to the embodiment described above, but it can be put into practice in various forms. For example, the arrangement patterns of the common contacts, non-common contacts, and extended portions of the stationary contacts described in the embodiment and the variations are only given by way of example, and it is possible to employ any arrangement pattern insofar as the contacts are arranged such that each extended portion of common contacts extends between two adjacent non-common contacts.

Further, although the key switch is configured to be pressed by the hammer, the present invention is by no means limited to this, but it may be applied to a key switch configured to be pressed by a key. Furthermore, although in the above-described embodiment, the switch body 30 is formed with the two front and rear pressure-receiving protuberances 51A and 51B, the number of them may be three or more.

It is further understood by those skilled in the art that the foregoing is a preferred embodiment of the invention, and that various changes and modifications may be made without departing from the spirit and scope thereof.

What is claimed is:

1. A key switch for an electronic piano, for detecting a motion of a pivotal member which is one of a key, and a hammer that pivotally moves in accordance with depression of the key, as key depression information, comprising:

a substrate on which first, second, and third stationary contacts are arranged side by side in a lengthwise direction of the pivotal member, each of the first to third stationary contacts comprising a common contact having a predetermined reference potential, and a non-common contact having a different potential from the reference potential, the common contact and the non-common contact being arranged in a direction orthogonal to the lengthwise direction of the pivotal member in a manner opposed to each other with a predetermined spacing therebetween, and at least one of the common contacts of each two stationary contacts adjacent to each other having an extended portion extending in the orthogonal direction in a manner inserted between two of the non-common contacts;

an elastic switch body mounted on said substrate and configured to be opposed to the pivotal member when the key is in a key-released state; and first, second, and third movable contacts arranged side by side on said switch body in a manner opposed to the respective first to third stationary contacts, and configured to be sequentially brought into contact with the common contacts and non-common contacts of the first to third stationary contacts as said switch body is pressed by the pivotal member pivotally moving during key depression, to thereby output signals indicative of the key depression information.

2. A key switch for an electronic piano, for detecting a motion of a pivotal member which is one of a key, and a hammer that pivotally moves in accordance with depression of the key, as key depression information, comprising:

a substrate on which first, second, and third stationary contacts are arranged side by side in a lengthwise direction of the pivotal member;

an elastic switch body mounted on said substrate and configured to be opposed to the pivotal member when the key is in a key-released state;

first, second, and third movable contacts arranged side by side on said switch body in a manner opposed to the respective first to third stationary contacts, and configured to be sequentially brought into contact with the first to third stationary contacts as said switch body is pressed by the pivotal member pivotally moving during key depression, to thereby output signals indicative of the key depression information; and a pressure-receiving protuberance formed on said switch body for abutment with the pivotally moving pivotal member and configured to cause a point of the abutment to shift in the lengthwise direction of the pivotal member during halfway through the pivotal motion of the pivotal member.

3. The key switch according to claim 2, wherein said pressure-receiving protuberance comprises a plurality of protuberances arranged side by side in the lengthwise direction of the pivotal member.

4. The key switch according to claim 2, wherein said pressure-receiving protuberance continuously extends in the lengthwise direction of the pivotal member.

5. The key switch according to claim 2, wherein said pressure-receiving protuberance is disposed close to said second movable contact on said switch body.

6. The key switch according to claim 2, further comprising a support protrusion which is disposed on said switch body at an opposite side of said first movable contact to said third movable contact and is opposed to said substrate, and wherein as said switch body is pressed by said pivotal member, said support protrusion is brought into abutment with said substrate to cause said switch body to pivotally move about a point of the abutment as a fulcrum.

7. The key switch according to claim 5, further comprising a support protrusion which is disposed on said switch body at an opposite side of said first movable contact to said third movable contact and is opposed to said substrate, and wherein as said switch body is pressed by said pivotal member, said support protrusion is brought into abutment with said substrate to cause said switch body to pivotally move about a point of the abutment as a fulcrum.

8. The key switch according to claim 3, wherein said pressure-receiving protuberance is disposed close to said second movable contact on said switch body.

9. The key switch according to claim 4, wherein said pressure-receiving protuberance is disposed close to said second movable contact on said switch body.

10. The key switch according to claim 3, further comprising a support protrusion which is disposed on said switch body at an opposite side of said first movable contact to said third movable contact and is opposed to said substrate, and wherein as said switch body is pressed by said pivotal member, said support protrusion is brought into abutment with said substrate to cause said switch body to pivotally move about a point of the abutment as a fulcrum.

11. The key switch according to claim 4, further comprising a support protrusion which is disposed on said switch body at an opposite side of said first movable contact to said third movable contact and is opposed to said substrate, and wherein as said switch body is pressed by said pivotal member, said support protrusion is brought into abutment with said substrate to cause said switch body to pivotally move about a point of the abutment as a fulcrum.

12. The key switch according to claim 8, further comprising a support protrusion which is disposed on said switch body at an opposite side of said first movable contact to said third movable contact and is opposed to said substrate, and wherein as said switch body is pressed by said pivotal member, said support protrusion is brought into abutment with said substrate to cause said switch body to pivotally move about a point of the abutment as a fulcrum.

13. The key switch according to claim 9, further comprising a support protrusion which is disposed on said switch body at an opposite side of said first movable contact to said third movable contact and is opposed to said substrate, and wherein as said switch body is pressed by said pivotal member, said support protrusion is brought into abutment with said substrate to cause said switch body to pivotally move about a point of the abutment as a fulcrum.

* * * * *